US007717319B2

(12) United States Patent
Adam

(10) Patent No.: US 7,717,319 B2
(45) Date of Patent: May 18, 2010

(54) RECLOSABLE FOLDING BOX WITH TAMPER-EVIDENT CLOSURE WITHOUT ADHESIVE

(75) Inventor: Meino Adam, Heidenheim (DE)

(73) Assignee: Carl Edelmann GmbH, Heidenheim (DE)

( * ) Notice: Subject to any disclaimer, the term of this patent is extended or adjusted under 35 U.S.C. 154(b) by 0 days.

(21) Appl. No.: 12/139,064

(22) Filed: Jun. 13, 2008

(65) Prior Publication Data

US 2008/0308619 A1 Dec. 18, 2008

(30) Foreign Application Priority Data

Jun. 14, 2007 (EP) ..... 07011715

(51) Int. Cl.
*B65D 5/43* (2006.01)
*B65D 5/02* (2006.01)

(52) U.S. Cl. ..... 229/102; 229/152; 229/153

(58) Field of Classification Search ..... 229/102, 229/148–153, 223; 206/807
See application file for complete search history.

(56) References Cited

U.S. PATENT DOCUMENTS 1,986,145 A 1/1935 Goodyear
1,989,659 A * 2/1935 Adsit et al. ..... 229/153
2,041,932 A 5/1936 Hutchins, Jr.
2,044,301 A 6/1936 Irving
2,116,652 A * 5/1938 Adler ..... 229/153
2,404,067 A 7/1946 Hill
3,543,995 A * 12/1970 Wilson ..... 229/102
4,752,028 A * 6/1988 Ogura ..... 229/102
6,860,421 B2 * 3/2005 Lo Duca ..... 229/102
6,957,765 B2 * 10/2005 Howell et al. ..... 229/151

FOREIGN PATENT DOCUMENTS

DE 198 09 466 9/1999
DE 100 46 179 5/2001
EP 0 884 247 12/1998
GB 2251600 A * 7/1992 ..... 229/102

* cited by examiner

*Primary Examiner*—Gary E Elkins
(74) *Attorney, Agent, or Firm*—Jansson Shupe & Munger Ltd.

(57) ABSTRACT

A reclosable folding box of paperboard with at least one tamper-evident closure is provided, which comprises a cover flap with an insertion tab, wherein the closure of the folding box can be closed by machine without the need for gluing, and the closure can be opened only by destroying the tamper-evident closure. It is characterized in that it comprises, in the interior, retaining means and a tear-off tab connected to the insertion tab by way of a predetermined break line, and in that the closure is set up in such a way that, the first time the box is opened, the tear-off tab cooperates with the retaining means and is torn off at the predetermined break line when the insertion tab is moved beyond the tearing edge.

27 Claims, 2 Drawing Sheets

RECLOSABLE FOLDING BOX WITH TAMPER-EVIDENT CLOSURE WITHOUT ADHESIVE

CROSS REFERENCE TO RELATED APPLICATION

This application claims priority based on European patent application EP 07 011 715.5, filed Jun. 14, 2007.

FIELD OF THE INVENTION

The invention pertains to the field of reclosable folding paperboard boxes.

DESCRIPTION OF THE PRIOR ART

According to the prior art, folding boxes are known which comprise a tamper-evident closure, wherein the closure must be glued during the final assembly of the folding box. Alternatively, folding boxes are provided with an (adhesive) label or sealed by polyethylene sealant. Because many packaging machines do not have a gluing device, for example, these additional, required steps prolong the final assembly process and make it more expensive. There is therefore a need for a folding box provided with a tamper-evident closure without adhesive.

A paperboard pocket with a tamper-evident closure is known from DE 198 09 466 A1. When the paperboard pocket is closed, a flap hinged to a sealing tab engages from the outside in an opening in the side wall of the paperboard pocket in such a way that, when the pocket is opened for the first time, that is, when the sealing tab is pulled out, the flap separates from the sealing tab. In comparison with a folding box, however, a paperboard pocket of this type suffers from the disadvantage that the closure is formed externally on the side wall, and as a result a smooth surface is not present. Smooth surfaces are important for these types of packages for mass-market articles, however, because they have no elevations, slots, etc. which could be gripped by an object.

DE 100 46 179 A1 discloses a folding box with tamper-evident closure. The box comprises an additional tab, which, when the box is opened, is completely or at least partially torn off along a perforation line. The disadvantage of this folding box is that, instead of a conventional closing mechanism, a narrow insertion tab is provided, which does not extend over the entire width of the cover flap and therefore interferes with the closing mechanism after the package has been opened for the first time.

SUMMARY OF THE INVENTION

The object of the present invention is therefore to provide an improved reclosable folding box with a tamper-evident closure, which can be handled as easily and as quickly as a conventional folding box during the final assembly process but which does not require any adhesive bonding or gluing.

This object is accomplished by the teaching of claim 1. Advantageous designs and embodiments are explained in the subclaims.

According to the invention, the folding box has retaining means in the interior and a tear-off tab connected to the insertion tab by way of a predetermined break line, and the closure of the folding box is set up in such a way that, the first time the box is opened, the tear-off tab cooperates with the retaining means and is torn off at the predetermined break line when the insertion tab is moved beyond the tearing edge.

It is advantageous for the retaining means to be designed as a retaining strip, especially when the paperboard is of such thickness that the end edges which come in contact with each other are able to block each other's movement. The tear-off tab runs up against this strip when the box is opened for the first time and is then torn off as the user continues to pull the tab in the opening direction.

As an alternative to the strip described above, the retaining means are advantageously designed as a retaining tab, which, in the as-delivered state, is folded down along a fold line onto the wide main panel opposite the cover flap, wherein the retaining tab and the wide main panel form a gap, into which the tear-off tab can be introduced in the opening direction of the closure. Because of the intrinsic elasticity of the paperboard material, the gap remains open when the tab is folded down. It is especially advantageous for the retaining tab to be glued to the wide main panel.

In a preferred embodiment, the wide main panel or the retaining tab comprises elevations or protections, one in the area to the right of the gap, and one in the area to the left. As a result, it is ensured that the gap remains open in the, as-delivered state. The elevations or projections also guarantee that the gap is effectively formed during the pre-gluing step and remains intact. The adhesive can be applied in the area of the elevations or projections, which results in effective gluing. It is also possible for the adhesive to be applied to other areas of the wide main panel or of the retaining tab outside the gap.

If the retaining means are designed as a retaining strip as described above, the elevations can be omitted, because the thickness of the retaining strip ensures that, when the folding box is closed for the first time, the tear-off tab, which, as a result of the intrinsic elasticity of the material, is resting against the wide main panel, will run up against the retaining strip, which offers a resistance which cannot be overcome.

In another embodiment, the retaining means are formed as a retaining tab hinged to the wide main panel. This retaining tab has a central opening in the hinge area, through which the tear-off tab can pass during the attempt to open the box and through which it is visible.

If the retaining means, the insertion tab, and the tear-off tab are provided with appropriate dimensions, it is also possible for the functionality of the tamper-evident closure to be arranged so that it is invisible from the outside. Thus a user, the first time he opens the box, does not have to use any particular care but rather can simply open the folding box in the conventional way. This prevents the user from being tempted to tamper with the tamper-evident closure in some way.

It is advantageous for the inventive folding box to have optical means for recognizing whether the tamper-evident closure has already been opened. Depending on the application, it can be necessary either to conceal completely the presence of a folding box's tamper-evident closure or to draw particular attention to the presence of the tamper-evident closure. When the latter alternative is realized, for example, the end user or buyer is informed that the purchased product is still in its originally packaged state.

In a preferred embodiment, the optical means are formed by a viewing window in the wide main panel, through which the tear-off tab can be seen in its original state.

In a preferred embodiment, the insertion tab comprises a central grip opening at the fold line between it and the cover flap. This grip opening makes it easier to open the folding box, because it allows sufficient force to be exerted on the closure during the opening process, as a result of which the tear-off tab can be pulled effectively past the tearing edge and thus effectively torn off.

It is especially advantageous for the paperboard blank from which the folding box is made to consist of a single piece of material.

BRIEF DESCRIPTION OF THE DRAWINGS

The invention is described in greater detail below with reference to the exemplary embodiment illustrated in the drawings.

DETAILED DESCRIPTION OF THE INVENTION

Figure 1:
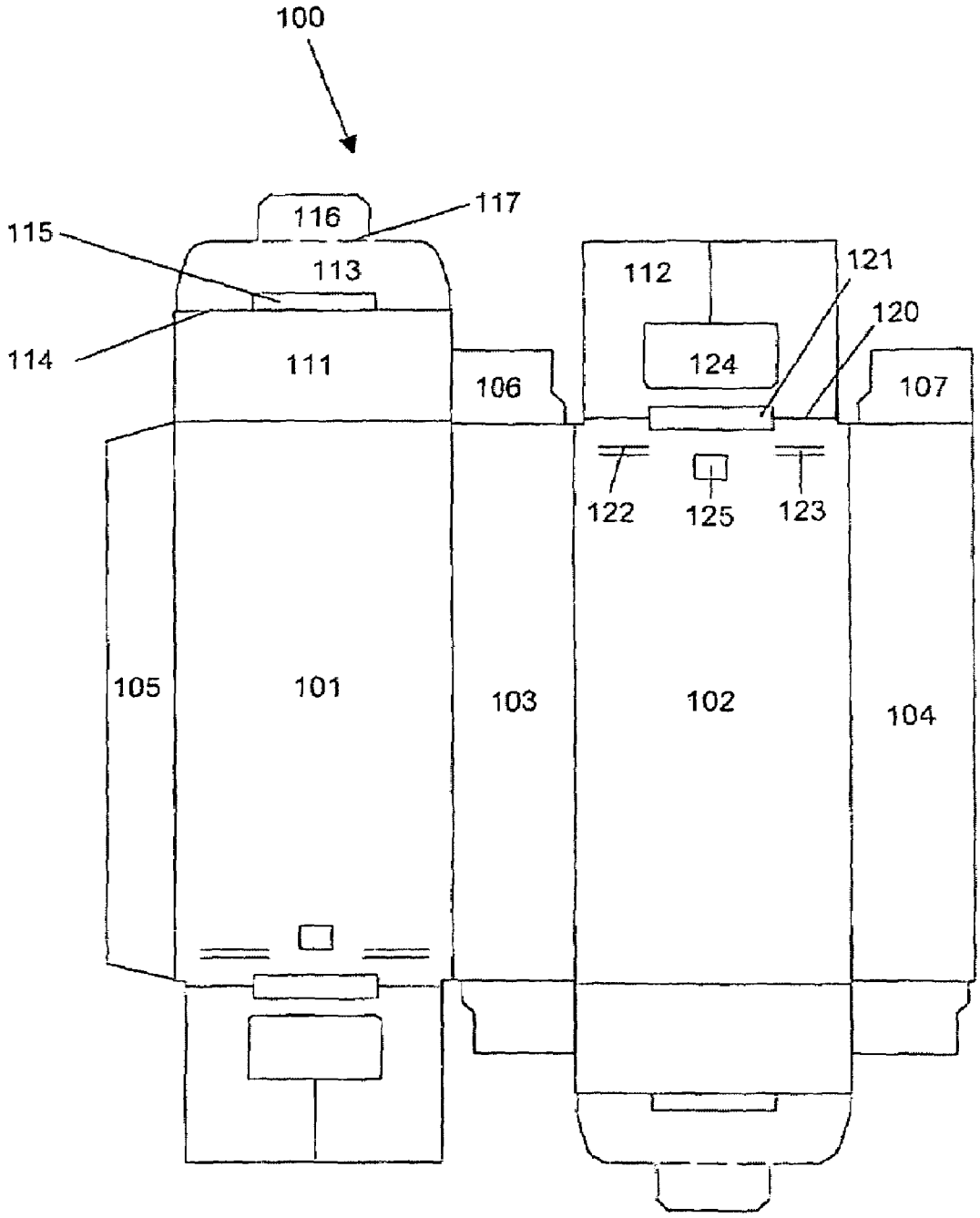
FIG. 1 shows the flat paperboard blank of a folding box according to a first embodiment of the invention.

FIG. 1 shows the flat paperboard blank 100 of an inventive folding box. Blank 100 consists of two wide main panels 101, 102 and two narrow main panels 103, 104, wherein a glue tab 105 adjoins one wide main panel 101. Alternatively, the glue tab 105 could also be located on another main panel. Sealing tabs 106, 107 are attached to the ends of each narrow main panel 103, 104. A cover flap 111 is attached to the wide main panel 101, and opposite it a retaining tab 112 is attached to the main panel 102. Because FIG. 1 shows a folding box blank for a folding box with two identical closures, which are arranged with point symmetry, the present invention can be explained on the basis of a description of only one of these closures. The second closure in FIG. 1 is not described, nor is it provided with any reference numbers. The arrangement of the closures can also be axially symmetric, which would allow both closures to be opened from the same side.

An insertion tab 113 is hinged along a fold line 114 to the cover flap 111. In the embodiment shown here, the insertion tab 113 comprises a grip opening 115 in the middle, along fold line 114. This opening 115 makes it easier to open the closure, but it can also be omitted. The free corners of insertion tab 113 are rounded to facilitate insertion. On the free, wide side of insertion tab 113, in the middle, a tear-off tab 116 is located, connected by way of a predetermined break line 117. The predetermined break line 117 is designed in such a way that it is possible to fold over the tear-off tab by nearly 180° in the direction opposite the folding direction of insertion tab 113. This is important for the function of the tamper-evident closure, as will be explained in detail in the following.

In the embodiment shown in FIG. 1 retaining tab 112 is hinged to wide main panel 102 by way of a fold line 120. In the middle of this fold line, an opening 121 is located, which is somewhat wider than tear-off tab 116. Height of opening 121 is small in comparison to its width. Elevations or protections 122, 123, which can be produced by pleating the other side of the folding box blank appropriately, are provided near fold line 120, offset laterally from opening 121. They serve, during the pre-gluing of the folding box, to produce a gap between wide main panel 102 and folded retaining tab 112, wherein the edge area of retaining tab 112 opposite opening 121 is glued to the area of wide main panel 102 located beyond, or, in this case, below projections 122, 123, In the embodiment shown, retaining tab 112 comprises another opening 124, the area of which is greater than that of tear-off tab 116, which allows the tab to fit into the opening. Alternatively, it is possible for the edge area of retaining tab 112 not to be continuous, but rather divided in two (as indicated by the solid line), as a result of which two tabs, pointing away from fold line 120, would be obtained, which would also be glued to wide main panel 102 on the other side of projections 122, 123.

Figure 2:
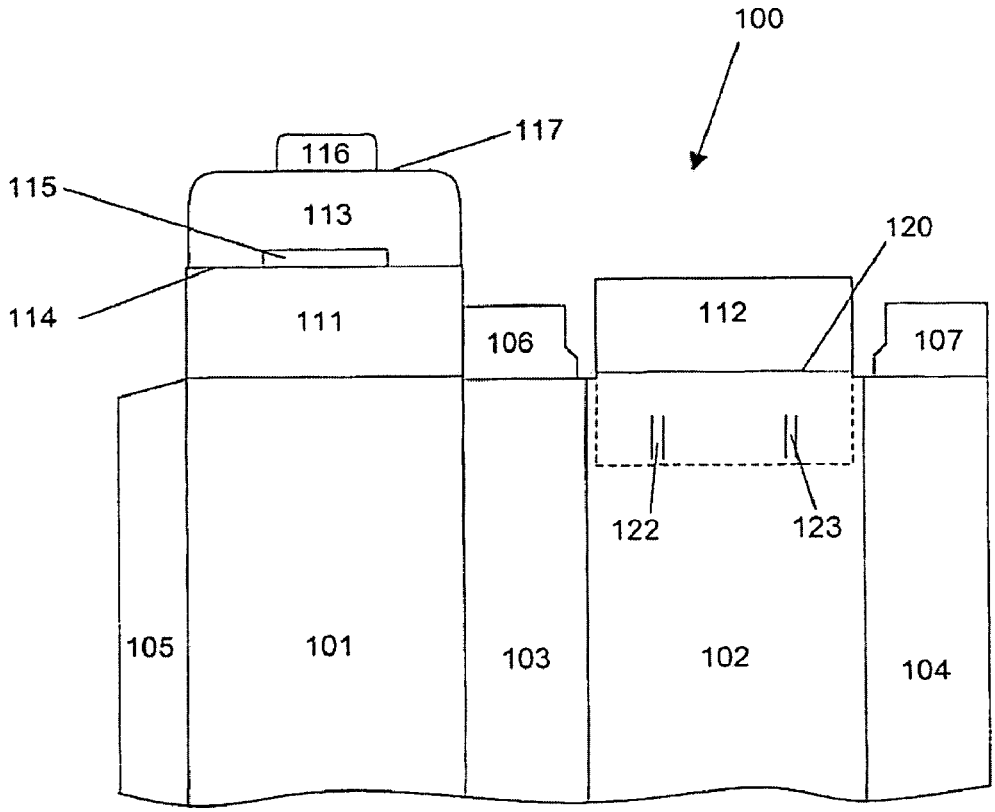
FIG. 2 shows the upper part of a flat paperboard blank of a folding box according to a second embodiment of the invention.

FIG. 2 shows the upper part of a flat paperboard blank of a folding box according to a second embodiment of the invention. The same reference numbers are used for the same elements as those appearing in FIG. 1. In this second embodiment, retaining tab 112 is connected at fold line 120 to wide main panel 102 all the way across. As in the first embodiment of FIG. 1, retaining tab 112 cooperates with wide main panel 102 to define a gap, into which tear-off tab 116 can fit when the closure is closed. In FIG. 2, the position of retaining tab 112 after production of the paperboard blank is shown in solid line, whereas the position of retaining tab 112 after preassembly is shown in broken line.

Retaining tab 112 of the second embodiment shown in FIG. 2 must have certain dimensions in order to fulfill the inventive closure function. The height of retaining tab 112, that is, the distance between fold line 120 and the free edge of retaining tab 112, is essentially smaller than the height of insertion tab 113, which is defined as the distance between fold line 114 and predetermined break line 117 minus the height of tear-off tab 116. Thus it is guaranteed that, when the closure is closed, the free edge of tear-off tab 116 is located directly in front of opening of the gap formed by gluing retaining tab 112 to wide main panel 102.

In the embodiment according to FIG. 2, projections 122, 123 are perpendicular to the opening direction. Other arrangements are also possible; however, after retaining tab 112 has been glued to wide main panel 102, the gap into which tear-off tab 116 will fit during the attempt to open the box should remain preserved. In addition, it is also possible for the gap thus defined to be produced not by projections but rather by intermediate layers of foil or paper, elevations, embossments and the like, for example.

An advantage of the embodiment according to FIG. 2 is that the tamper-evident closure of the closed folding box is not visible. Because fold line 120 extends across the entire width of the connection between retaining tab 112 and main panel 102, the gap in front of which the tear-off tab is located in the interior is hidden. Since nothing has to be figured out first in order to open the box, the normal user or buyer will therefore proceed in the conventional manner without any particular caution and thus break open the tamper-evident closure more easily than will be the case with the embodiment of FIG. 1.

The function of the inventive folding box with tamper-evident closure is described in the following in detail on the basis of the embodiment shown in FIG. 1. The sequence of steps is not to considered limiting on the invention in any way.

The folding box blank shown in FIG. 1 is produced out of suitable material, including paperboard or the like, and provided in the example with the appropriate pleats, projections, elevations, embossments, fold lines, and predetermined break lines. In the first step, folding tab 112 is folded along fold line 120. Sufficient adhesive is applied to the gluing area of retaining tab 112 or of wide main panel 102, and retaining tab 112 is folded down onto wide main panel 102 and glued to it. Sufficient adhesive is then applied to the outside of glue tab 105, and glue tab 105 is glued to narrow main panel 104. The result of the pre-gluing process completed so far is a so-called "pre-glued folding box", which is delivered in the flat-folded state by the package manufacturer (the "as-delivered state").

These types of pre-glued folding boxes are then filled with the products in question by known packaging machines. Before they are filled, the flat, pre-glued folding box is set upright, and side tabs 106, 107 at one end of folding box 100 are folded over 90°, and this one end of the folding box is closed. After the inventive folding box with tamper-evident closure has been filled, it is ready to be closed at the other end. For this purpose, first side tabs 106, 107 and then cover flap 111 and insertion tab 113 are folded over 90° toward the inside. Tear-off tab 116 is folded almost 180° in the opposite folding direction. Then insertion tab 113, together with the tear-off tab 116, is introduced into the opening of the folding box. After cover flap 111 has been closed completely, the pretension of the paperboard material causes tear-off tab 116 to latch itself in the gap formed between retaining tab 112 and wide main panel 102. If the folding box blank of the embodiment shown in FIG. 1 is used, the outward-facing surface of tear-off tab 116 is now visible through the viewing window 125.

With the tamper-evident closure now closed, the folding box with its content is now in the "original package" state. In the preferred embodiment, grip opening 115 in insertion tab 113 of the closure is visible. When the user grips this grip opening 115 and pulls cover flap 111 and thus the entire tamper-evident closure outward, that is, in the opening direction, tear-off tab 116 moves through the gap in the opening direction. As a result, tear-off tab 116 becomes visible in opening 121 or even projects out beyond the long edge of the opening. When the cover flap is pulled carefully out even farther in the opening direction, it is possible to feel a latching effect when the predetermined break line 117 of the tear-off tab comes to rest against the break point, i.e., tearing edge, on retaining tab 112. Movement beyond this tearing edge causes tear-off tab 116 to be torn off along predetermined break line 117. This tearing-off is clearly visible through viewing window 125. Viewing window 125 can be formed by a complete cutout, which can have any desired area of sufficient size for viewing, and it can be covered by transparent film, for example, to prevent anyone from tampering with the tamper-evident closure. Torn tear-off tab 116 remains inside the folding box but not in its original position, so that it can be seen at any time that the tamper-evident closure has been broken.

With the inventive object, a folding box with tamper-evident closure is provided which can be handled easily and quickly during final assembly and which does not require gluing.

The invention claimed is:

1. A reclosable folding box of sheet material with at least one tamper-evident closure, which includes a cover flap with an insertion tab, wherein the tamper-evident closure of the folding box can be mechanically closed without the need for gluing, and the tamper-evident closure can be opened only by destroying the tamper-evident closure, wherein the folding box comprises retaining means which, in an as-delivered state, is folded down at a fold line onto a main panel opposite the cover flap and forms a gap with the main panel, the retaining means is introduced into the gap thereby being located in the interior and invisible from the outside of the reclosable folding box and a tear-off tab connected to the insertion tab by way of a predetermined break line, the tamper-evident closure of the reclosable folding box being configured such that, the first time the reclosable folding box is opened, the tear-off tab cooperates with the retaining means and is torn off at the predetermined break line when the insertion tab is moved away from the retaining means.

2. The reclosable folding box of claim 1 wherein the sheet material is a blank of a single piece of material.

3. The reclosable folding box of claim 1 wherein the insertion tab has a central grip opening on a fold line connecting the insertion tab to the cover flap.

4. The reclosable folding box of claim 3 wherein the sheet material is a blank of a single piece of material.

5. The reclosable folding box of claim 1 wherein the folding box comprises optical means for detecting whether or not the tamper-evident closure has been opened.

6. The reclosable folding box of claim 5 wherein the optical means are formed by a viewing window in a wide main panel, through which the tear-off tab can be seen in an unbroken state of the tamper-evident closure.

7. The reclosable folding box of claim 1 wherein the retaining means are designed as a retaining strip.

8. The reclosable folding box of claim 7 wherein the sheet material is a blank of a single piece of material.

9. The reclosable folding box of claim 7 wherein the insertion tab has a central grip opening on a fold line connecting the insertion tab to the cover flap.

10. The reclosable folding box of claim 7 wherein the folding box comprises optical means for detecting whether or not the tamper-evident closure has been opened.

11. The reclosable folding box of claim 10 wherein the optical means are formed by a viewing window in a wide main panel, through which the tear-off tab can be seen in an unbroken state of the tamper-evident closure.

12. The reclosable folding box of claim 1 wherein the retaining means are designed as a retaining tab and the main panel is a wide main panel.

13. The reclosable folding box of claim 12 wherein the sheet material is a blank of a single piece of material.

14. The reclosable folding box of claim 12 wherein the insertion tab has a central grip opening on a fold line connecting the insertion tab to the cover flap.

15. The reclosable folding box of claim 12 wherein the folding box comprises optical means for detecting if the tamper-evident closure has been opened.

16. The reclosable folding box of claim 15 wherein the optical means are formed by a viewing window in the wide main panel, through which the tear-off tab can be seen in an unbroken state of the tamper-evident closure.

17. The reclosable folding box of claim 12 wherein the retaining tab has a central opening in the area of the fold line, through which the tear-off tab can pass.

18. The reclosable folding box of claim 12 wherein, in an as-delivered state, the retaining tab is glued to the wide main panel opposite the cover flap.

19. The reclosable folding box of claim 18 wherein the sheet material is a blank of a single piece of material.

20. The reclosable folding box of claim 18 wherein the insertion tab has a central grip opening on a fold line connecting the insertion tab to the cover flap.

21. The reclosable folding box of claim 18 wherein the folding box comprises optical means for detecting whether or not the tamper-evident closure has been opened.

22. The reclosable folding box of claim 21 wherein the optical means are formed by a viewing window in a wide main panel, through which the tear-off tab can be seen in an unbroken state of the tamper-evident closure.

23. The reclosable folding box of claim 18 wherein the wide main panel or the retaining tab has an embossment allowing the gap to remain open in an assembled state.

24. The reclosable folding box of claim 18 wherein the retaining tab has a central opening in the area of the fold line, through which the tear-off tab can pass.

25. The reclosable folding box of claim 12 wherein the wide main panel or the retaining tab has an embossment allowing the gap to remain open in an assembled state.

26. The reclosable folding box of claim 25 wherein the folding box comprises optical means for detecting whether or not the tamper-evident closure has been opened.

27. The reclosable folding box of claim 25 wherein the retaining tab has a central opening in the area of the fold line, through which the tear-off tab can pass.

* * * * *

UNITED STATES PATENT AND TRADEMARK OFFICE

CERTIFICATE OF CORRECTION

PATENT NO. : 7,717,319 B2
APPLICATION NO. : 12/139064
DATED : May 18, 2010
INVENTOR(S) : Adam It is certified that error appears in the above-identified patent and that said Letters Patent is hereby corrected as shown below:

In column 2, line 20, delete “protections” and insert -- projections --.

In column 2, line 22, after the second occurrence of the word “the”, delete the “,”.

In column 3, line 51, delete “protections” and insert -- projections --.

Signed and Sealed this

Thirtieth Day of November, 2010

David J. Kappos

David J. Kappos
*Director of the United States Patent and Trademark Office*